United States Patent [19]

MacDonald et al.

[11] Patent Number: 5,038,419

[45] Date of Patent: Aug. 13, 1991

[54] POOL COVER DRAINING DEVICE

[76] Inventors: Scott H. MacDonald, 3736 Inglewood Blvd. #9; William E. MacDonald, 3455 Stoner Ave., both of Los Angeles, Calif. 90066

[21] Appl. No.: 579,546

[22] Filed: Sep. 10, 1990

Related U.S. Application Data

[63] Continuation of Ser. No. 351,728, May 15, 1989, abandoned, which is a continuation of Ser. No. 128,025, Dec. 3, 1987, abandoned, which is a continuation of Ser. No. 832,474, Feb. 20, 1986, abandoned.

[51] Int. Cl.[5] ..... E04H 4/10

[52] U.S. Cl. ..... 4/502

[58] Field of Search ..... 4/498, 499, 502, 503; 220/219

[56] References Cited

U.S. PATENT DOCUMENTS

| | | | |
|---|---|---|---|
| 3,184,764 | 5/1965 | West | 4/498 |
| 3,474,931 | 10/1969 | Daniels et al. | 220/219 |
| 3,982,286 | 9/1976 | Foster | 4/502 |
| 4,001,900 | 1/1977 | Lamb | 4/498 |
| 4,094,021 | 6/1978 | Rapp | 4/503 |
| 4,233,695 | 11/1980 | Rowney | 4/498 |
| 4,606,083 | 8/1986 | Kingston | 4/498 X |

FOREIGN PATENT DOCUMENTS

| | | | |
|---|---|---|---|
| 471470 | 3/1974 | Australia | 4/503 |
| 2638192 | 3/1978 | Fed. Rep. of Germany | 4/498 |

*Primary Examiner*—Charles E. Phillips

[57] ABSTRACT

An openable and closable opening is formed in a pool cover, adjacent to or at the pool cover leading edge, and a mechanism for enabling opening and closing of the cover opening is provided.

Upon opening of the cover opening, water, which may accumulate on the pool cover when the cover is extended over the pool, is able to drain through the cover opening into the pool during retraction of the cover.

Upon closing of the cover opening, the cover may be smoothly and evenly extended so as to cover, and retracted so as to uncover the pool.

A mesh bag depends from the sides of the cover adjacent the cover opening, so as to prevent objects from falling through the opened cover opening into the pool.

A foam strip is secured to the mesh bag, so as to enable the section of the cover which includes the opening therein to float if the cover contacts the water in the pool, so as to prevent such water from being scooped onto the cover during retraction thereof.

11 Claims, 2 Drawing Sheets

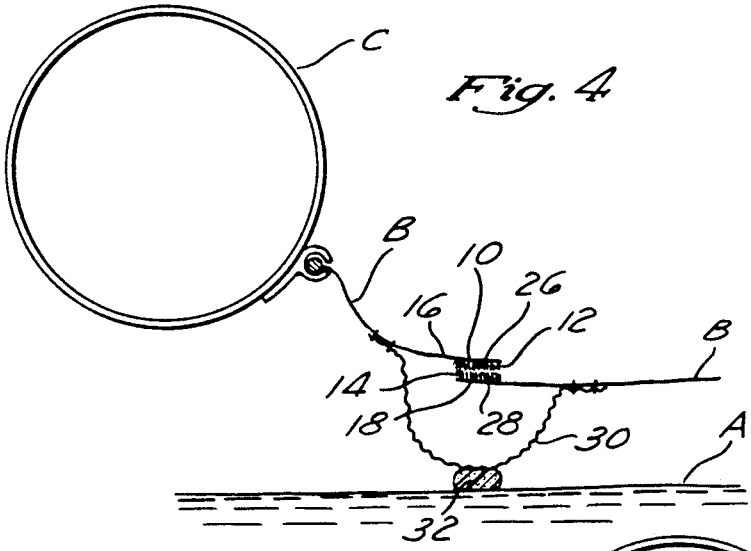
Fig. 4
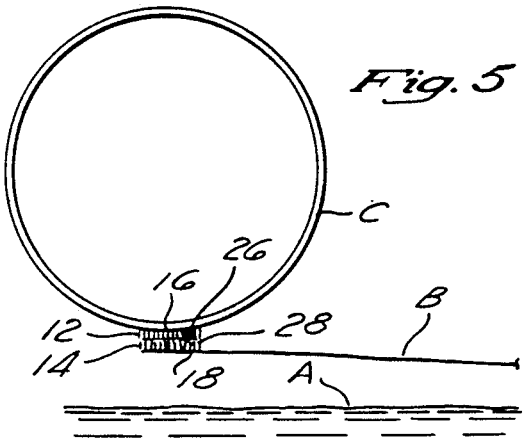
Fig. 5
Fig. 6
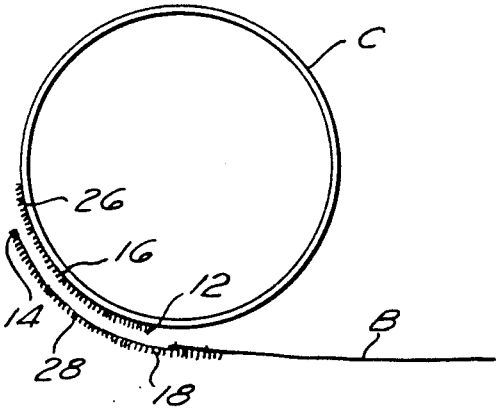
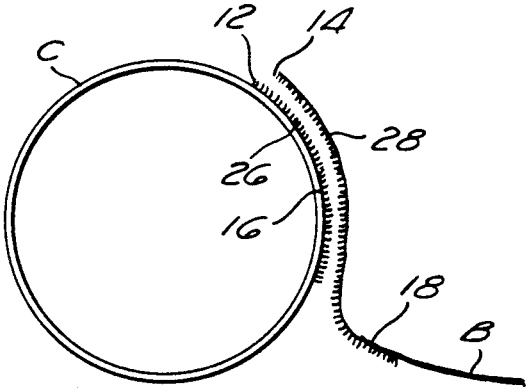
Fig. 7

POOL COVER DRAINING DEVICE

This application is a continuation of application Ser. No. 351,728, filed 5/15/89 which is a continuation of Ser. No. 07/128,025, filed 12/3/87, which is a continuation of Ser. No. 06/832,474, filed 2/20/86, all now abandoned.

BACKGROUND OF THE INVENTION

The invention relates generally to pool covering devices, and relates specifically to a device for draining water, which may accumulate on a pool cover, into the pool.

When a pool cover is extended over a pool, water may accumulate on such cover by virtue of rainfall or otherwise. When the cover is retracted by a cover winding motor so as to uncover the pool, the weight of such accumulated water resists operation of, and acts as a drag on, such motor, causing stress, damage, stalling, and burnout of such motor.

In order to remove such accumulated water from the pool cover, it has been known in the art to provide a drainage opening in the cover for draining such water into the pool therethrough, as for example in U.S. Pat. Nos. 3,982,286 and 4,001,900.

However, such pool cover drainage openings have not been effective and efficient.

In U.S. Pat. No. 3,982,286, the permeable section of the cover is always open, during both extension and retraction of the cover, which results in stresses and strains on the cover, at and about such cover permeable section, during winding and unwinding of the cover, causing the cover to roll and unroll in an uneven manner.

Further, such cover permeable section is intended to be at or near the level of water in the pool, during retraction of the cover, which subjects it to submerging and scooping water onto the cover during such retraction, causing drag on the cover winding motor with the resultant problems therefrom as set forth above.

In U.S. Pat. No. 4,001,900, the central gore is likewise always open adjacent the leading edge of the pool cover, but it is raised during extension and retraction of such cover thereby preventing draining therethrough. Further, such open gore is intended to extend downwardly, for draining, only when the cover is fully extended over the pool, not during retraction or extension of the cover.

SUMMARY OF THE INVENTION

The device of the invention is adapted to overcome the above problems, as well as others, associated with known devices.

It includes a selectively openable and closable opening formed in the pool cover.

Such openable and closable cover opening, upon opening thereof, is adapted to enable draining of accumulated water from the cover into the pool during retraction of the cover from its extended pool covering position. Such draining prevents the weight of such water from generating drag on the cover winding motor, which would otherwise cause stress, damage, stalling, and burnout of such motor.

Further, the openable and closable cover opening, upon closing thereof, is adapted to enable the cover to be extended and retracted smoothly and evenly, so as to reduce stress and strain on the cover during such operations.

The device further includes a depending mesh bag, secured to the sides of the cover adjacent the opening. The mesh bag is adapted to prevent objects such as leaves from draining into the pool along with the accumulated water, during retraction of the cover. It is further adapted to impede anything, such as a child, from entering into the pool through the opened cover opening.

The device still further includes a foam strip, secured to the mesh bag, adapted to enable the opened cover opening to float on the water in the pool, if the cover comes into contact with the pool water. The foam strip is further adapted to prevent the opened cover opening from sinking in the pool, which would cause the cover to scoop water thereonto during retraction thereof, generating resistance and drag on the cover winding motor, and the problems associated therewith.

BRIEF DESCRIPTION OF THE DRAWINGS

FIG. 4 is a side elevational partly-fragmentary sectional view of the pool, pool cover, cover leading edge, and a second embodiment of the openable and closable cover opening and mechanism for opening and closing thereof, with the cover opening closed;

FIG. 5 is a similar view of a third embodiment of the openable and closable pool cover opening, and mechanism for opening and closing thereof, with the cover opening closed;

FIG. 6 is a similar view of a fourth embodiment of the openable and closable pool cover opening, and mechanism for opening and closing thereof, with the cover opening opened; and FIG. 7 is a similar view of a fifth embodiment of the openable and closable pool cover opening, and mechanism for opening and closing thereof, with the cover opening opened.

DESCRIPTION OF THE PREFERRED EMBODIMENTS

The device of the invention, as shown in FIGS. 1–7 and as described herein, enables draining into a pool A, through an openable and closable opening 10 in a pool cover B, of water which may accumulate, by rainfall or otherwise, on cover B when cover B covers pool A. Such draining, upon opening of cover opening 10, is enabled during retraction of cover B from its extended pool-covering position, thereby enabling removal of such accumulated water from cover B, so as to prevent the weight of such water from causing cover B to drag, resisting winding up of cover B, which may in turn cause stress, damage, stalling, and burning out of the motor which winds up cover B.

The device further enables the cover opening 10 to be closed, such that cover B is integral, without any opened opening therein, during extension of cover B from its retracted pool-uncovering position, and during retraction of cover B from its extended pool-covering position, as desired by the user. It thereby enables cover B to be smoothly and evenly wound and unwound when water has not accumulated on cover B, and when draining of water is therefore not desired by the user.

Figure 2:
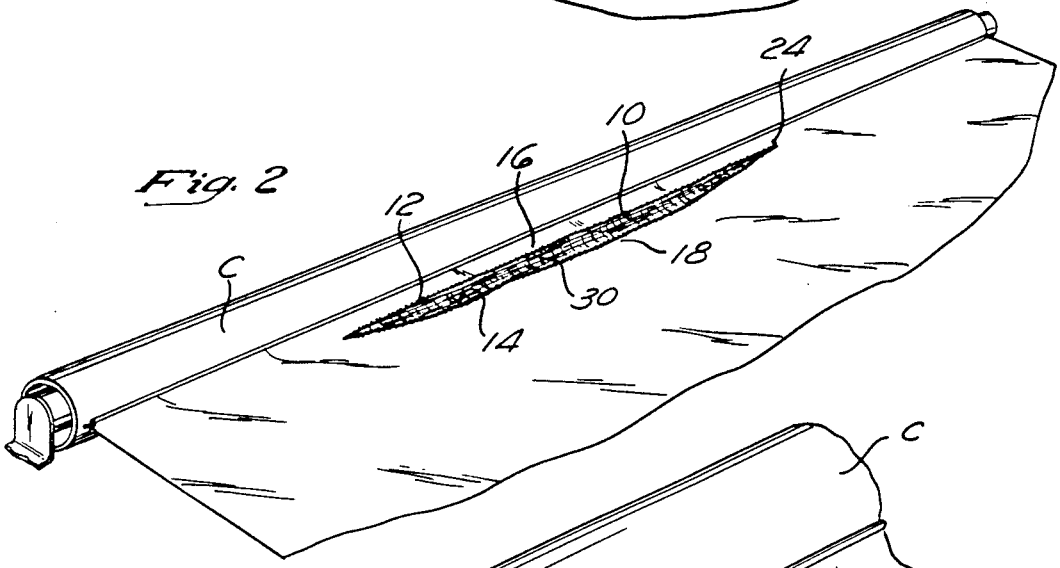
FIG. 2 is a perspective partly-fragmentary view thereof, with the cover opoening opened.
Figure 3:
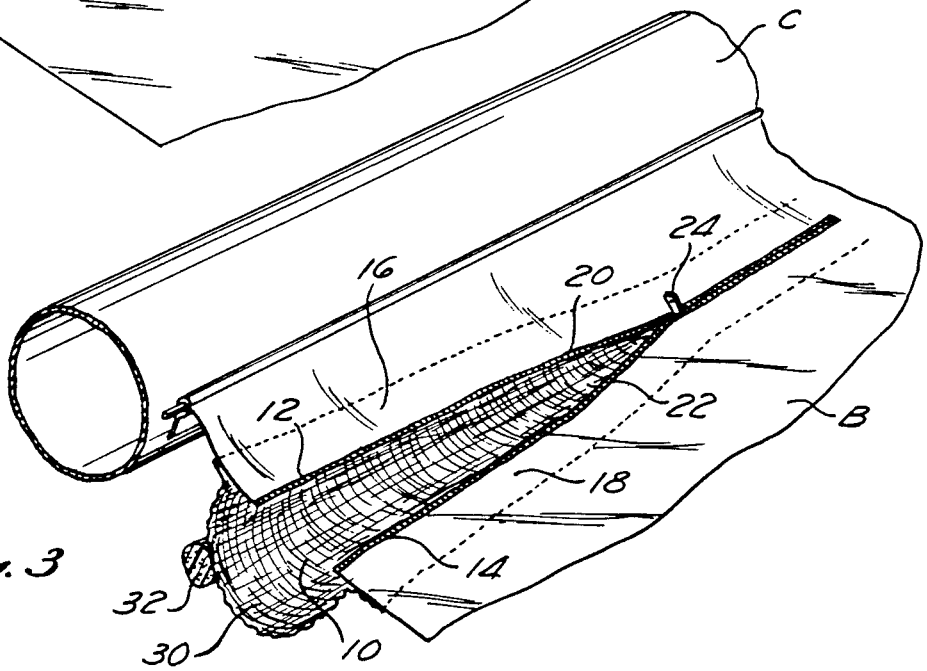
FIG. 3 is a perspective fragmentary partly-sectional view thereof, with the cover opening partially open.

The openable and closable cover opening 10, as shown in FIGS. 2–3, is defined by adjacent edges 12 and 14 formed in cover B, which form adjacent sides 16 and 18 in cover B.

Figure 1:
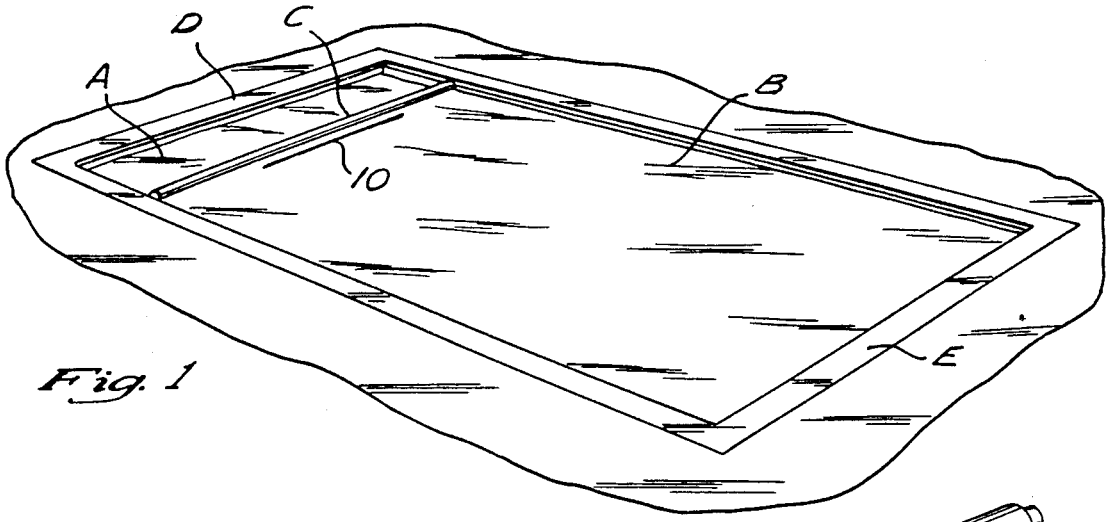
FIG. 1 is a perspective view of a pool, pool cover, and a first embodiment of an openable and closable cover opening and mechanism for opening and closing thereof, with the cover opening closed, pursuant to the invention.

Cover opening 10 extends transverse to, and over less than the width of, cover B, as shown in FIGS. 1–3. It is located in cover B so as to be accessible to the user when cover B is extended in its pool-covering position, and when cover B is retracted in its pool-uncovering position.

Cover B has a leading edge C which supports one end of cover B, as shown in FIGS. 1–7. Cover opening 10 extends proximate to, and generally parallel with, leading edge C, in the embodiments shown in FIGS. 1–4. Cover opening 10 extends at leading edge C, in the embodiments shown in FIGS. 5–7.

Adjacent edges 12 and 14 of cover B, which define opening 10, are engagable and disengagable, comprising engagable and disengagable teeth, as 20 and 22 in FIG. 3, in the embodiment shown in FIGS. 1–3. Adjacent edges 12 and 14 and adjacent sides 16 and 18 of cover B overlap, in the embodiment shown in FIGS. 4–7. One of the overlapping adjacent opening-defining edges 12 and one of the overlapping adjacent sides 16 are secured to leading edge C, in FIGS. 5–7.

The device further includes a mechanism for enabling the user to open and close cover opening 10 as desired.

Such mechanism, in the embodiment shown in FIGS. 1–3, comprises a slider 24, which slidably engages and disengages teeth, as 20, 22, in the engagable and disengagable opening-defining cover edges 12 and 14, for closing and opening cover opening 10 as desired.

Such mechanism, in another embodiment shown in FIGS. 4–7, comprises strips 26 and 28 of Velcro material, engagable with and disengagable from each other. Such strips 26 and 28 of Velcro material are secured to overlapping adjacent edges 12 and 14, and sides 16 and 18, of cover C (FIG. 4) and of cover B and leading edge C (FIGS. 5–7).

The device further includes a mesh bag 30, shown in FIGS. 2–4, for preventing objects from going into pool A through opening 10 when opening 10 is opened. Mesh bag 30 is secured to, and depends from adjacent sides 16 and 18 of cover B.

The device still further includes a foam strip 32, secured to mesh bag 30, as shown in FIGS. 3–4, for enabling cover opening 10 to float on the water in pool A if cover B contacts the water in pool A. Such foam strip 32 prevents the opened cover opening 10 from sinking and scooping water onto cover B from pool A during retraction of cover B from its extended pool-covering position.

Initially, cover B may be extended over pool A so as to cover same, with leading edge C of cover B at end D of pool A, and with opening 10 in cover B closed.

Water may then accumulate on cover B, by rainfall or otherwise. Such water would tend to accumulate on cover B at a location spaced from the ends of cover B at which cover B is supported, and generally towards or at the middle of cover B. Cover B is supported at one end thereof by leading edge C, from which such accumulated water would tend to be spaced. The water would tend to cause cover B to sag at the location of such accumulation thereof.

To enable such accumulated water to be removed from cover B, so as to prevent the weight of such water from causing stress, damage, stalling, and burning out of the motor which winds up cover B, the user has access to, and may reach, cover opening 10 from end D of pool A proximate to which opening 10 would then extend, and may open opening 10.

Cover opening 10 may be opened by a mechanism which, in the embodiments shown in FIGS. 2 and 3, comprises a slider 24 which disengages teeth, as 20 and 22, and in the embodiments shown in FIGS. 4–7, comprises Velcro strips 26 and 28 which may be separated and disengaged from each other.

With cover opening 10 opened during retraction of cover B from its extended pool covering position, the accumulated water will move towards and through opened cover opening 10 into pool A, thereby draining the cover of such accumulated water.

Mesh bag 30 filters out large objects such as leaves, from going into pool A, enabling removal of such objects at end E of pool A after cover B has been wound up. Further, if cover B remains extended over pool A with opening 10 opened, mesh bag 30 will interfere with anything, such as a child, falling into pool A through opened opening 10, thereby enhancing the safety of use of the device.

Foam strip 32 enables mesh bag 30, to which it is secured, and in turn cover opening 10 and adjacent sides 16 and 18 of cover B to which mesh bag 30 is secured, to float in the event that there is sufficient slack in cover B, resulting from accumulated water thereon, to otherwise cause cover B to contact the water in pool A. Such operation prevents the weight of such water from causing opening 10 to submerge and scoop water onto cover B during retraction of cover B from its extended pool-covering position.

Upon winding up of cover B, such that cover opening 10 is at end E of pool A, the user may remove objects filtered by mesh bag 30, and may close opening 10.

Cover opening 10 may be closed, in the embodiment shown in FIGS. 2 and 3, by sliding slider 24 so as to engage teeth, as 20 and 22, and in the embodiments shown in FIGS. 4–7, by joining and engaging velcro strips 26 and 28.

With opening 10 closed, cover B may be extended from its retracted pool-uncovering position and retracted from its extended pool-covering position smoothly and evenly, without any opened cover opening therein.

Openable and closable cover opening 10, upon opening thereof, enables the device of the invention to drain accumulated water from cover B during retraction of cover B from its extended pool-covering position, preventing the weight of such water from dragging cover B, and in turn preventing stress, damage, stalling, and burning out of the winding motor for cover B.

Such cover opening 10, upon closing thereof, enables cover B to be integral, without any opened opening therein, during retraction of cover B from its extended pool-covering position, and during extension of cover B from its retracted pool-uncovering position, for smooth and even winding and unwinding of cover B.

Mesh bag 30 prevents objects from falling through opened opening 10 into pool A, for filtering and safety purposes.

Foam strip 32 enables opening 10 to float in the event that it would otherwise contact the water in pool A, preventing opening 10 from scooping water onto cover B during retraction of cover B from its extended pool-covering position.

Preferred embodiments of the device of the invention have been set forth above, for the purpose of explaining the invention. However, it is to be understood that variations may be made in such embodiments, which variations are nevertheless within the scope and spirit of the invention as set forth in the claims herein.

We claim:

1. A device for enabling water, which may accumulate on a cover of a pool when the cover is extended over the pool, to drain into the pool, while the cover is extended over the pool, and during retraction of the cover from the extended position thereof by reeled means, and for enabling the cover to extend over the pool, or to be retracted from the extended position, or extended from the retracted position, without enabling water to drain through the cover into the pool, as desired by the user, comprising:

a) a cover having a top surface and an opposed bottom surface, a trailing end and a leading end, said leading end attached to a reel, b) the cover including adjacent portions defining an openable and closeable opening adjacent said trailing end;

c) means connected to the adjacent cover opening-defining portions, for enabling opening or closing of the cover opening from the top surface as desired by the user, adapted to enable access thereto when the cover is extended or retracted, for enabling opening of the cover opening-defining portions when the cover is extended, such that accumulated water may drain directly into the pool while the cover is extended and during the reeled retraction of the cover from the extended position thereof, and for enabling closing of the cover opening-defining portions when the cover is extended or retracted, such that the cover may extend over the pool or be retracted about the reel from the extended position or extended from the retracted position while preventing water from draining through the cover into the pool; and, d) a mesh bag secured to said bottom surface surrounding the cover opening-defining portions for catching objects that may pass through said opening.

2. A device as in claim 1, further comprising means for enabling the cover opening-defining portions to float on water in the pool if the cover is positioned so as to come into contact with the water in the pool.

3. A device as in claim 1, in which the float enabling means comprise a piece of foam secured to the cover opening-defining portions.

4. A device as in claim 1, in which the cover opening-defining portions extend across, and for less than the width of, the cover.

5. A device as in claim 1, in which the cover opening-defining portions extend across a substantial portion of the cover.

6. A device as in claim 1, in which the cover opening-defining portions are engagable and disengagable.

7. A device as in claim 6, in which the engagable and disengagable opening-defining portions of the cover comprise engagable and disengagable teeth, and the opening and closing enabling means comprise a slider, adapted to engage and disengage the teeth relative to the engagable and disengagable cover opening-defining portions, for enabling opening and closing of the cover opening-defining portions.

8. A device as in claim 1, in which the cover opening-defining portions are overlapable.

9. A device as in claim 8, in which the opening and closing enabling means comprise strips of Velcro material, secured to the overlapable opening-defining portions of the cover, adapted to be engagable with and disengagable from each other for enabling opening and closing of the cover opening.

10. A device as in claim 1, in which the cover includes a lengthwise axis, and the cover opening-defining portions extend transverse to the lengthwise axis of the cover.

11. A device as in claim 8, in which the opening and closing enabling means comprise strips of Velcro material, secured to the overlapping opening-defining portions of the cover, adapted to be engagable with and disengagable from each other for enabling opening and closing of the cover opening, one of the Velcro strips being secured to the cover leading edge.

* * * * *